US006003864A

United States Patent [19]

Kuo et al.

[11] Patent Number: 6,003,864

[45] Date of Patent: Dec. 21, 1999

[54] JAM CLEARANCE FEATURES FOR MODULAR-TYPE DECURLER HAVING CONTINUOUS BENDING NIP

[75] Inventors: Youti Kuo, Penfield; Roger C. Male; Anthony G. Poletto, both of Fairport; Alfred Zielinski, Rochester, all of N.Y.

[73] Assignee: Xerox Corporation, Stamford, Conn.

[21] Appl. No.: 08/838,628

[22] Filed: Apr. 11, 1997

[51] Int. Cl.[6] ..... B65H 5/02; B65H 29/70

[52] U.S. Cl. ..... 271/272; 271/69; 271/188; 271/264; 271/273; 271/274

[58] Field of Search ..... 271/69, 188, 264, 271/272, 273, 274, 314

[56] References Cited

U.S. PATENT DOCUMENTS

| | | | |
|---|---|---|---|
| 3,948,511 | 4/1976 | Smith et al. | 271/116 |
| 3,982,752 | 9/1976 | Langford | 271/264 |
| 4,353,543 | 10/1982 | Ikeda et al. | 271/273 |
| 4,875,670 | 10/1989 | Peterson et al. | 271/265 |
| 5,078,385 | 1/1992 | Serita | 271/296 |
| 5,215,298 | 6/1993 | Stemmie et al. | 271/186 |
| 5,317,377 | 5/1994 | Rubscha et al. | 271/186 |
| 5,326,092 | 7/1994 | Ando | 271/272 |
| 5,326,093 | 7/1994 | Sollitt | 271/306 |
| 5,653,439 | 8/1997 | Rider et al. | 271/188 |

FOREIGN PATENT DOCUMENTS

| | | |
|---|---|---|
| 0 547 308 A1 | 6/1993 | European Pat. Off. . |
| 60262764 | 12/1985 | Japan . |
| 08225218 | 9/1996 | Japan . |

OTHER PUBLICATIONS

Xerox Disclosure Journal vol. 8, No. 4, Jul./Aug. 1983, p. 297–298; "Paper Eject Baffle" by: Kurtz and Smith.

*Primary Examiner*—Donald P. Walsh
*Assistant Examiner*—Daniel K Schlak
*Attorney, Agent, or Firm*—Kevin R. Kepner

[57] ABSTRACT

A self adjusting jam prevention guide and jam clearance baffle for a printing machine. A moveable guide is attached to a machine subsystem module and is moveable from a first position to a second position. In the first position the guide bridges a gap between the machine subsystem module and a preceding subsystem module. In the second position, the guide is retracted from the gap to allow easy removal of one of the subsystem modules. The moveable guide is preferably self actuated by the use of a biasing device and a ramped section so that the movement of one of the adjacent subsystem modules causes extension and retraction of the guide. A jam clearance aid is further attached to the exit of the machine subsystem module. The clearance aid uses a J-shaped channel to cause a sheet fed into a jammed sheet to buckle and cause both the first jammed sheet and subsequent sheets to be partially ejected from the paper path for easy removal therefrom.

15 Claims, 7 Drawing Sheets

JAM CLEARANCE FEATURES FOR MODULAR-TYPE DECURLER HAVING CONTINUOUS BENDING NIP

BACKGROUND OF THE ART

This invention relates generally to a sheet path baffle for an electrophotographic printing machine, and more particularly concerns a self adjusting sheet guide and a jam removal baffle for a sheet path.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In printing machines such as those described above, during the fusing process, toner images are fixed to papers by a heated roll that removes moisture from the paper and, as a result, causes the paper to curl due to moisture and temperature gradients across the thickness of the paper. Many copier machines are equipped with decurlers for reducing curl for improving the reliability of paper handling as well as for customer satisfaction.

The curl direction of an incoming sheet to a decurler depends on the curl direction created by a fuser under the effect of image area coverage, paper basis weight and the humidity. It also depends on the system control of a copier machine that may change the orientation of an incoming sheet into the decurler due to the requirement of an output device. For example, in some machines, the input simplex sheets for a mailbox are image down (up curl) while that for a disc finisher are image up (down curl) as a result of inversion of output sheets by an inverter prior to exiting IOT and before entering the disc finisher. Therefore, the entrance baffle assembly of a decurler positioned at the exit of an IOT needs to guide both TI and AI curls as any of above-mentioned output devices can be interchangeably connected to the IOT.

For the ease of clearing a jammed sheet at the decurler entrance, which can occur very frequently because of severely curled sheets entering the decurler, the input device (a fuser or an inverter) which delivers sheets to the decurler is designed to be a slideable module which can be pulled out by an operator for jam clearance or for service. To have sufficient clearance between the two device, a physical gap between the two needs to be designed into a machine for robustness to avoid any possibility of interference due to manufacturing tolerances of the two devices and their supporting frame. This interface gap, however, is a cause for jams of curled sheets if it cannot be closed or reduced during the machine operation to prevent sheets from entering the gap.

It is desirable to have a self-adjusting entrance baffle that is pivotally mounted to the two side plates of the decurler. The entrance baffle has a lower guide surface and an upper guide surface which form a convergent channel for nudging papers into the decurling nip. It is further desirable to have a baffle which will cause jammed sheets to be driven out of a nip for easy jam clearance.

The following disclosures may relate to various aspects of the present invention.

U.S. Pat. No. 5,326,093

Patentee: Sollitt

Issue Date: Jul. 5, 1994

Xerox Disclosure Journal

Inventors: Kurtz et al.

Vol. 8, No. 4, Pg. 297

Some portions of the foregoing disclosures may be briefly summarized as follows:

U.S. Pat. No. 5,326,093 discloses a universal interface for operatively connecting and feeding the sequential copy sheet output of various reproduction machines of widely varying ranges of sheet output level heights to various independent copy sheet processing units having widely varying sheet input level heights with a free-standing movable interface module of a fixed narrow width. A sheet feeding path extends from one side of the module to the other for transporting the copy sheets. This sheet feeding path is preferably bi-directional and reversible for feeding copy sheets therethrough from either side. It is repositionable by vertically repositioning over a large vertical height range integral sheet path ends opening at opposite sides of the interface module, a retention system retains the sheet path ends at a selected height position mating with a selected reproduction apparatus sheet output level and a selected copy sheet processing unit sheet input level. The disclosed sheet feeding path varies in length automatically with this path end repositioning, yet remains substantially linear, and may utilize baffles telescoping automatically.

Xerox Disclosure Journal, Vol. 8, No. 4 discloses a paper eject baffle that curls a sheet that is jammed as a transport is pulled out of a machine. The curl allows a sheet to move past frame members without tearing or jamming further.

SUMMARY OF THE INVENTION

In accordance with one aspect of the present invention, there is provided a self adjusting sheet baffle apparatus for bridging a gap in a sheet path, comprising a pair of elongated members located adjacent and substantially parallel to each other so as to form a sheet guide throat therebetween, a support member connecting said parallel members at each end thereof to form a guide assembly and a retaining member, located on said support member to movably attach the support member within the sheet path, wherein the guide assembly is moveable from a first position which bridges a gap in the sheet path, to a second position which opens the gap.

Pursuant to another aspect of the invention there is provided a self adjusting sheet baffle for connecting a plurality of subsystem modules in an electrophotographic printing machine, comprising a pair of elongated members located adjacent and substantially parallel to each other so as to form a sheet guide throat therebetween, a support member connecting said parallel members at each end thereof to form a guide assembly and a retaining member, located on said support member to movably attach the support member to a first subsystem module, wherein the guide assembly is moveable from a first position which bridges a gap between the subsystem modules, to a second position which opens the gap.

Other features of the present invention will become apparent as the following description proceeds and upon reference to the drawings, in which:

DETAILED DESCRIPTION OF THE PREFERRED EMBODIMENT

While the present invention will be described in connection with a preferred embodiment thereof, it will be understood that it is not intended to limit the invention to that embodiment. On the contrary, It is intended to cover all alternatives, modifications, and equivalents as may be included within the spirit and scope of the invention as defined by the appended claims.

Figure 1:
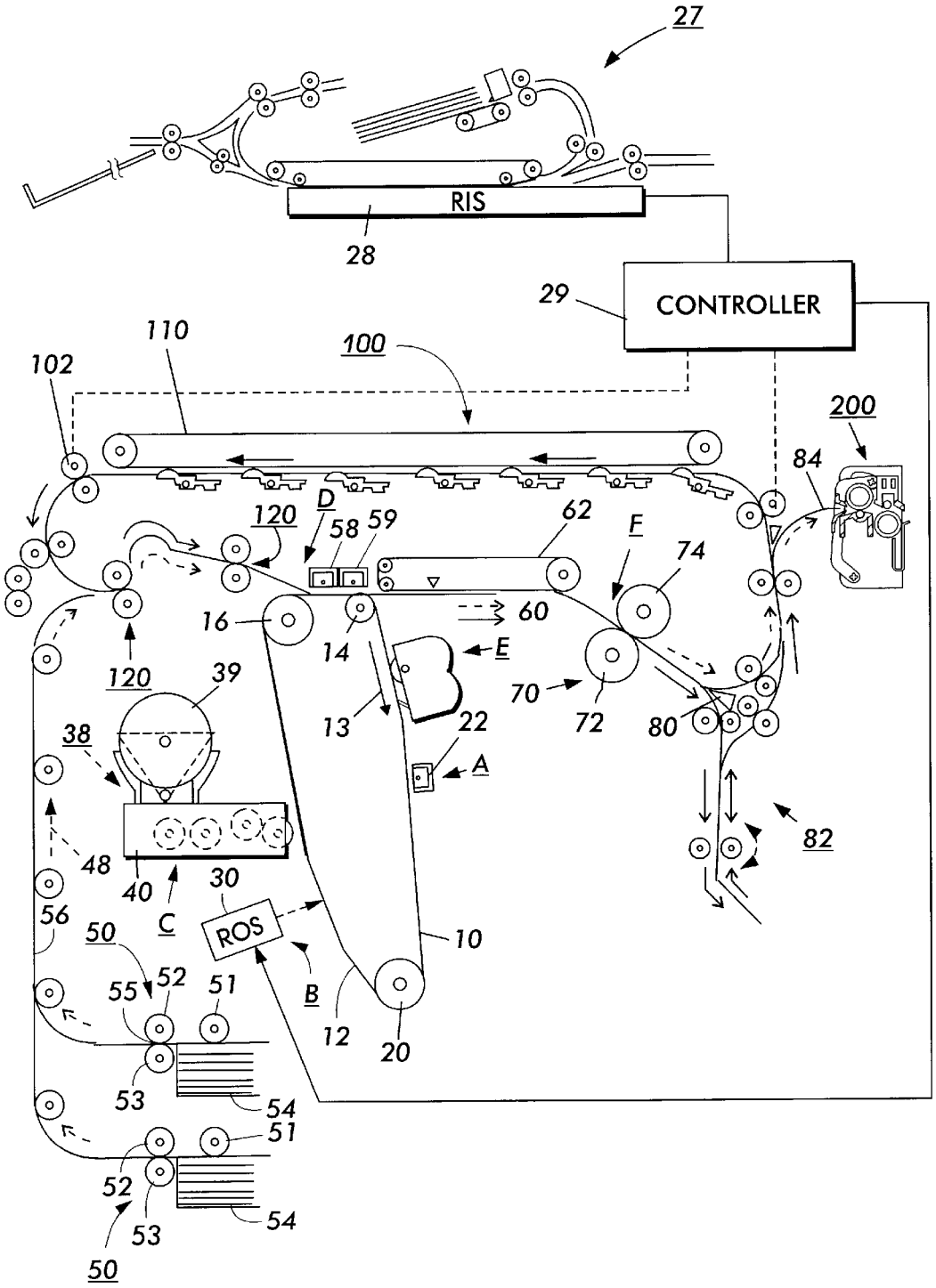
FIG. 1 is a schematic elevational view of a typical electrophotographic printing machine utilizing the jam clearance features of the present invention.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the jam clearance features of the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 20 and drive roller 16. As roller 16 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 39, dispenses toner particles into developer housing 40 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a nudger roll 51 which feeds the uppermost sheet of stack 54 to nip 55 formed by feed roll 52 and retard roll 53. Feed roll 52 rotates to advance the sheet from stack 54 into vertical transport 56. Vertical transport 56 directs the advancing sheet 48 of support material into the registration transport 120 of the invention herein, described in detail below, past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet is then detacked from the photoreceptor by corona generating device 59 which sprays oppositely charged ions onto the back side of sheet 48 to assist in removing the sheet from the photoreceptor. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 16 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 84. Sheet path 84 includes the single path bidirectional decurler 200 of the present invention, more fully described below.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2:
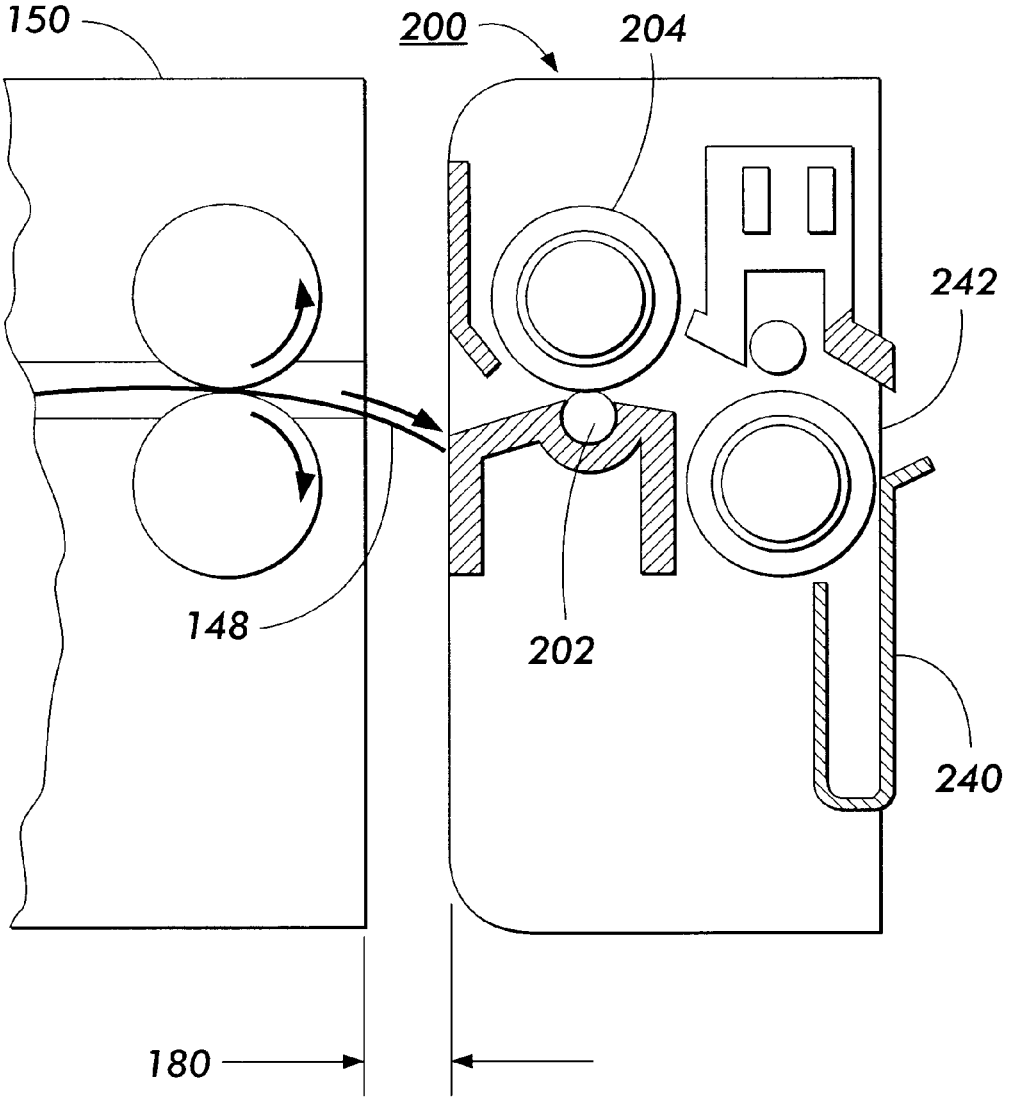
FIG. 2 is a side view illustrating the gap between two machine subsystem modules.

Referring to FIG. 2, for ease of clearing a jammed sheet at a decurler entrance 201, which can occur very frequent because of severely curled papers 48 entering the decurler 200, the input device 150 (such as a fuser or an inverter) which delivers papers to the decurler 200 is designed to be a slideable module which can be pulled out by an operator for jam clearance or for service. To have sufficient clearance between the two devices, a physical gap represented by arrows 180 between the two devices as shown in FIG. 2 needs to be designed in for robustness to avoid any possibility of interference due to manufacturing tolerances of the two devices and their supporting frame. This interface gap 180, however, is a cause for jams of curled papers if it cannot be closed or reduced during the machine operation to prevent papers from entering the gap.

Figure 3:
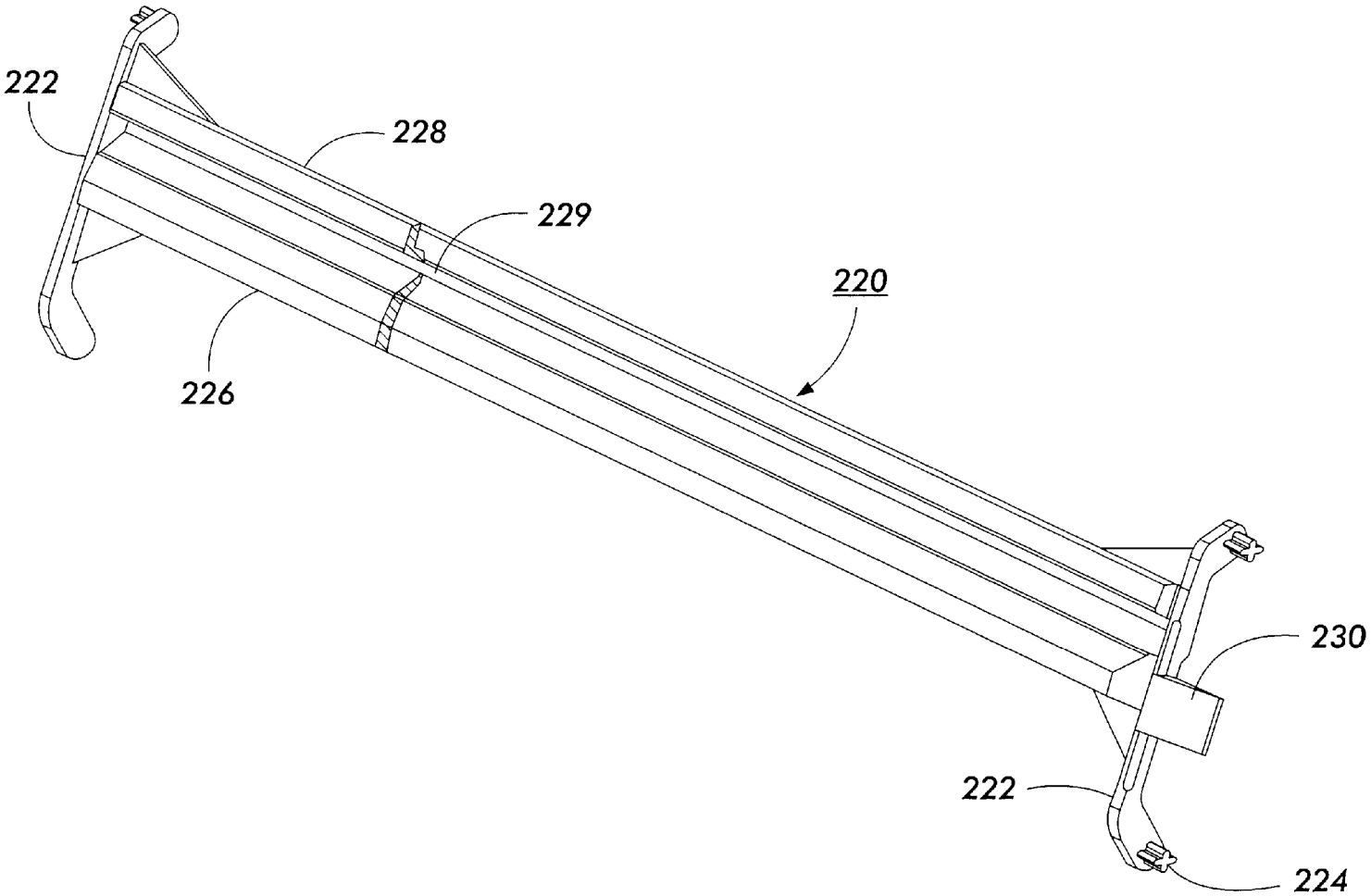
FIG. 3 is a perspective view of the moveable, self adjusting entrance guide of the present invention.
Figure 4:
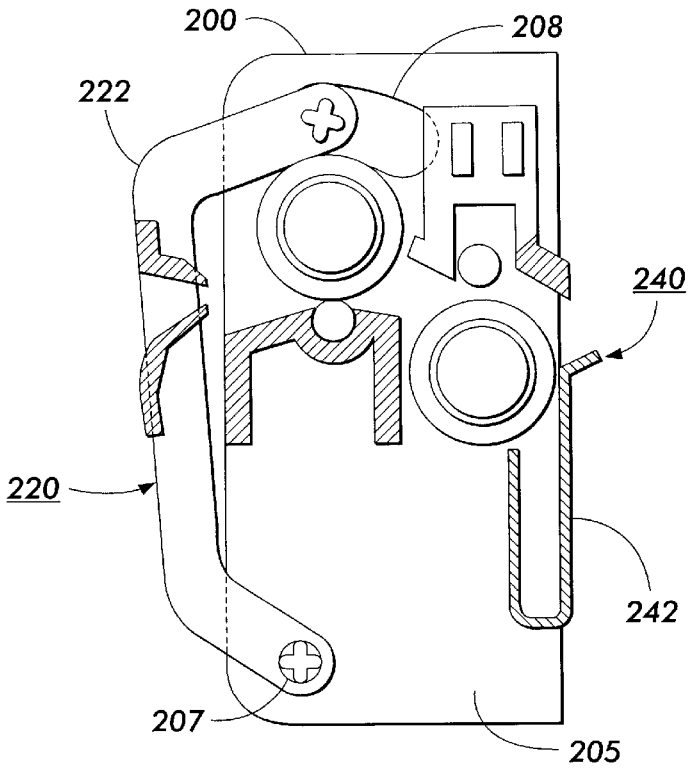
FIGS. 4 and 5 are side views illustrating the self adjusting entrance guide mounted on a decurler subsystem module in the extended and retracted positions.
Figure 5:
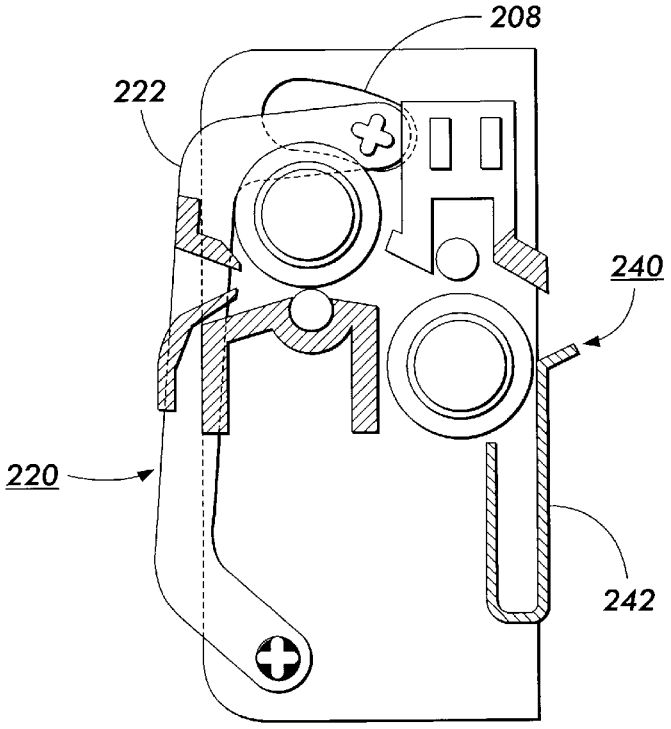
Figure 6:
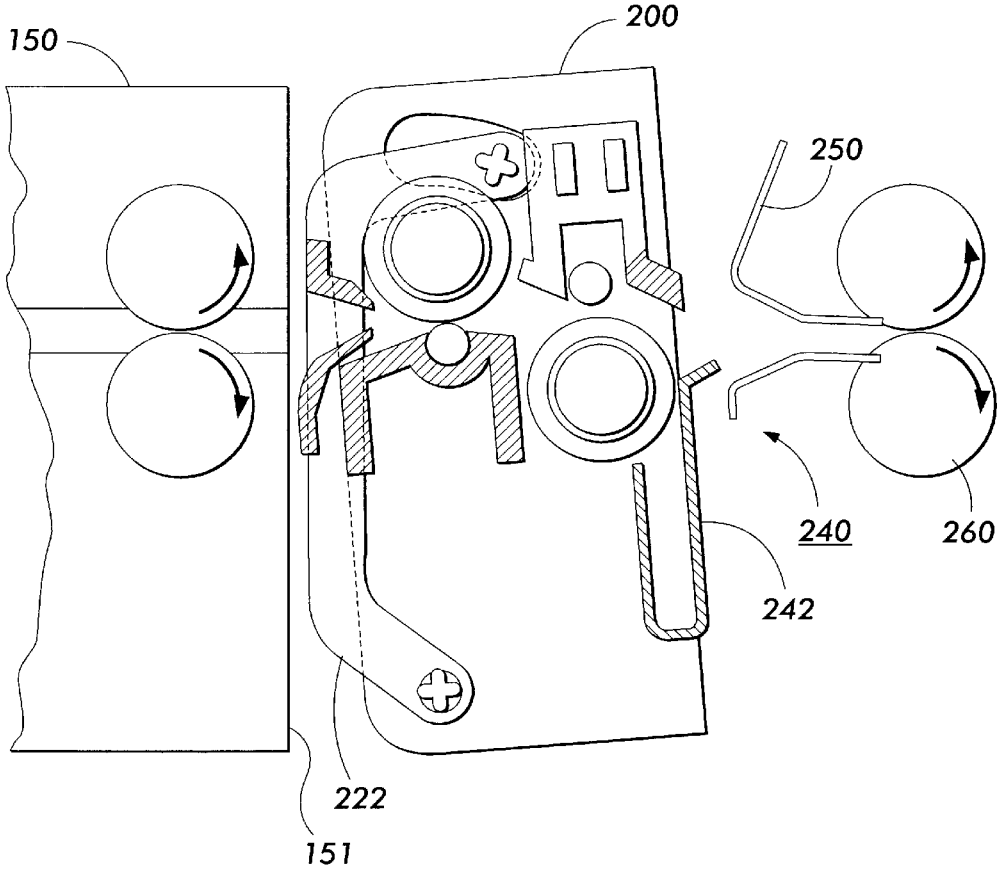
FIG. 6 is a side view of the decurler module illustrating the self adjusting guide in the operative position.

In order to bridge the gap 180, FIG. 3 shows a self-adjusting entrance baffle 220 that is pivotally mounted to the two side plates 205 (FIG. 4) of the decurler 200. The entrance baffle 220 has a lower guide surface 226 and an upper guide surface 228 which form a convergent channel 229 for nudging sheets into the decurling nip. The two guide surfaces are connected by end members 222 at the ends of the entrance baffle 220 as shown in FIG. 3, which also has pivoting studs 224 for inserting into the corresponding slots 207, 208 in the side plates 205 (FIG. 4) which provide structural support for the decurler elements. The end member 222 at the outboard end of the machine has an angled ramp feature 230 for being pushed in by the sliding action of the input device 150. All of these functional features and the entrance baffle can be molded in one piece as shown in FIG. 3. The mounting of the entrance baffle can be slightly inclined such that it may extend out by the gravity to reach the exit wall 151 (FIG. 6) of the input device 150 to bridge or close the paper path gap 180 between the two devices. FIGS. 4 and 5 show an extended and a pushed-in position of the entrance baffle 220. FIG. 6 shows the contact between the entrance baffle 220 and the exit wall 151 of the slideable input module 150 that eliminates the gap 180 between the two devices. Optionally springs (not shown) or the resiliency of a molded plastic material can also be utilized to push out the entrance baffle 220 to bridge the gap 180. For ease of assembly, a molded entrance baffle is preferred as its flexibility enables the pivoting studs 224 to be snap-fit into the slots 207, 208 in the side plates 205.

Figure 7:
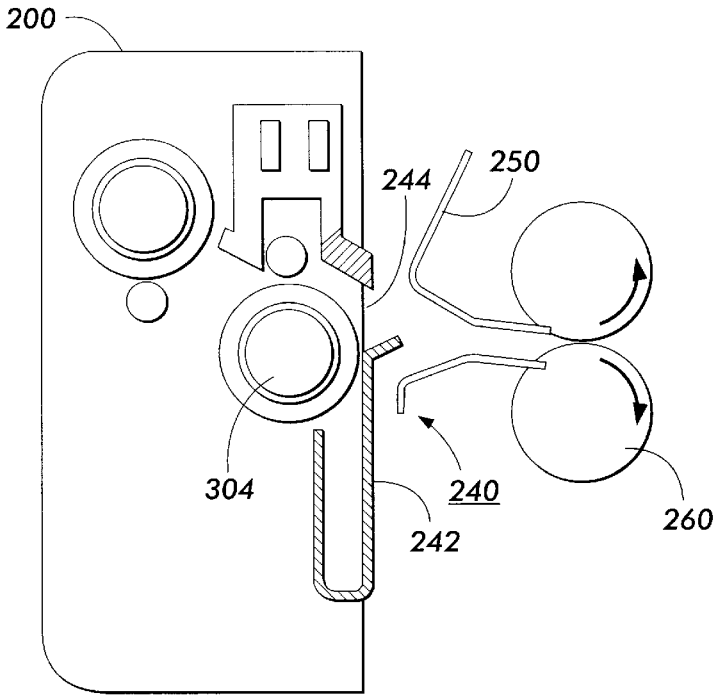
FIGS. 7 through 10 inclusive illustrate the function of the jam removal guide located at the exit of the decurler module.
Figure 8:
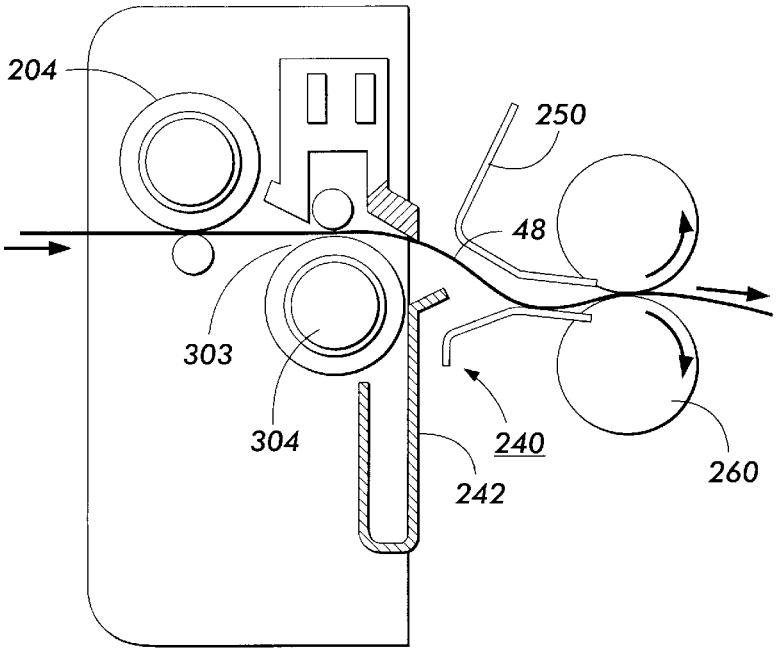
Figure 9:
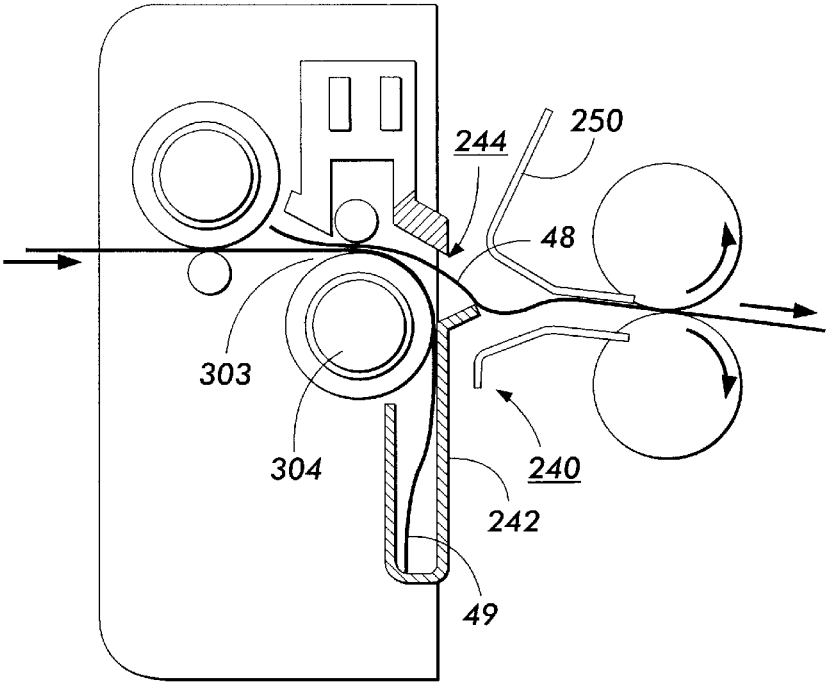
Figure 10:
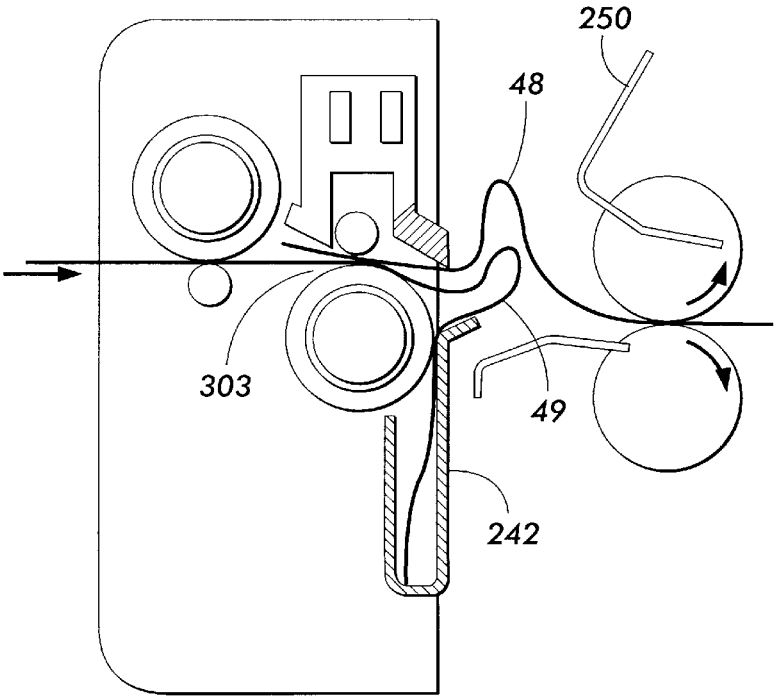

With reference now to FIGS. 7 through 10, to avoid unclearable jams, the exit baffle 240 of the decurler includes a J-shaped pocket 242 for capturing a jammed sheet, which is shown in FIG. 7. Referring to FIG. 8, when a paper jam occurs, a jammed sheet 48 may be stopped between the decurler nip 303 and the entrance drive nip 260 of the output device. This jammed first sheet 48 as shown in FIG. 8 may create blockage and the proximity structure of the output device may become a barrier for the subsequent second sheet 49 to advance elsewhere. In the worse case the jammed second sheet 49 or the following sheets may be forced to wrap around the drive roll 304 of the decurler 200 such that the sheet 49 becomes unclearable. The unclearable jam can be prevented by the J-shaped pocket 242. As illustrated in FIG. 9, when a sheet 49 is being deflected by the jammed preceding sheet 48, its lead edge is forced to enter the J-shaped pocket 242. As the beam strength of the sheet 49 prevents its lead edge adhering to the surface of the small drive roll 304, the tangential movement of the lead edge causes it to stub on the bend of the J-shaped pocket 242. This stubbing action causes the paper to buckle which forces the preceding jammed sheet to pop up, and as a result, makes it easier to clear the jammed sheets. FIG. 10 shows the presence of the folded sheets at the decurler exit 244 available for removal as the jam clearance baffle 250 of the output device is opened.

For a sensor controlled copier machine, a paper sensor can detect the jamming of a sheet in the interface area of a decurler and an output device. Once a jam is detected, the machine system shuts down the drive motor. Due to the coasting of the motor the drive system can still cause the following or the second sheet to move into the jam area.

However, the control software of the machine can divert the third and the subsequent sheets away from the jam area to avoid piling up of jammed sheets in that area. This jam clearance strategy enables the effectiveness of the J-shaped pocket baffle 242 to capture jammed second sheet and prevents the wrapping of subsequent sheets on the decurler drive roll 304.

Note that the approach of stripper fingers used for a fuser roll is not appropriate for preventing jams in the decurler exit. The use of stripper fingers is not reliable for small decurler roll (about 22 mm in diameter) and are a source of paper jams.

While the invention herein has been described in the context of black and white electrophotographic printing machine, it will be readily apparent that the device can be utilized in any printing machine involving the transport of cut sheets.

In recapitulation, there is provided a self adjusting jam prevention baffle and jam clearance guide for a printing machine. A moveable guide is attached to a machine subsystem module and is moveable from a first position to a second position. In the first position the guide bridges a gap between the machine subsystem module and a preceding subsystem module. In the second position, the guide is retracted from the gap to allow easy removal of one of the subsystem modules. A jam clearance aid is further attached to the exit of the machine subsystem module. The clearance aid uses a J-shaped channel to cause a sheet fed into a jammed sheet to buckle and cause both the first jammed sheet and subsequent sheets to be partially ejected from the paper path for easy removal therefrom.

It is, therefore, apparent that there has been provided in accordance with the present invention, a self adjusting sheet baffle and jam clearance aid that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A self adjusting sheet baffle apparatus for bridging a gap in a sheet path, comprising:

a pair of elongated members located adjacent and substantially parallel to each other so as to form a sheet guide throat therebetween;

a support member connecting said parallel members at each end thereof to form a guide assembly;

a retaining member, located on said support member to movably attach the support member within the sheet path, wherein the guide assembly is moveable from a first position which bridges a gap in the sheet path, to a second position which opens the gap.

2. An apparatus according to claim 1, further comprising a biasing member to move said guide assembly from the second position to the first position.

3. An apparatus according to claim 2, further comprising an actuator, located on one of said support members, to exert a force on said assembly to overcome the force exerted by said biasing member to move said guide assembly from the first position to the second position.

4. An apparatus according to claim 2, wherein said biasing member comprises a spring, said spring attached at a first end to said support member and attached at a second end to a portion of the paper path.

5. An apparatus according to claim 2, wherein said biasing member comprises said support member having a bias built into a portion thereof such that said support member is bent when in said first position and the resiliency of said support member acts as the bias.

6. An apparatus according to claim 1, further comprising a jam clearance baffle comprising:

a sheet output nip;

a J-shaped channel, located adjacent said sheet output nip;

a sheet removal aperture located in said sheet path adjacent and opposite said J-shaped channel such that a jammed sheet will cause a subsequent sheet to be diverted into said J-shaped channel wherein a lead edge of the subsequent sheet will stub in the J-shaped channel causing a buckle to form in the subsequent sheet, the buckle will force the subsequent sheet and the jammed sheet into said sheet removal aperture.

7. A self adjusting sheet baffle for connecting a plurality of subsystem modules in an electrophotographic printing machine, comprising:

a pair of elongated members located adjacent and substantially parallel to each other so as to form a sheet guide throat therebetween;

a support member connecting said parallel members at each end thereof to form a guide assembly;

a retaining member, located on said support member to movably attach the support member to a first subsystem module, wherein the guide assembly is moveable from a first position which bridges a gap between the subsystem modules, to a second position which opens the gap.

8. A printing machine according to claim 7, further comprising a biasing member to move said guide assembly from the second position to the first position.

9. A printing machine according to claim 8, further comprising an actuator, located on one of said support members, to exert a force on said assembly to overcome the force exerted by said biasing member to move said guide assembly from the first position to the second position.

10. A printing machine according to claim 8, wherein said biasing member comprises a spring, said spring attached at a first end to said support member and attached at a second end to a portion of one of the subsystem modules.

11. A printing machine according to claim 8, wherein said biasing member comprises said support member having a bias built into a portion thereof such that said support member is bent when in said first position and the resiliency of said support member acts as the bias.

12. An apparatus according to claim 7, further comprising a jam clearance baffle comprising:

a sheet output nip in one of the subsystem modules;

a J-shaped channel, located adjacent said sheet output nip;

a sheet removal aperture located in said sheet path adjacent and opposite said J-shaped channel such that a jammed sheet will cause a subsequent sheet to be diverted into said J-shaped channel wherein a lead edge of the subsequent sheet will stub in the J-shaped channel causing a buckle to form in the subsequent sheet, which buckle will force the subsequent sheet and the jammed sheet into said sheet removal aperture.

13. A self adjusting sheet baffle for connecting a plurality of subsystem modules in an electrophotographic printing machine, comprising:

a pair of elongated members located adjacent and substantially parallel to each other so as to form a sheet guide throat therebetween:

a support member connecting said parallel members at each end thereof to form a guide assembly;

a retaining member, located on said support member to movably attach the support member to a first subsystem module, wherein the guide assembly is moveable from a first position which bridges a gap between the subsystem modules, to a second position which opens the gap, wherein said retaining member comprises an aperture located on the first subsystem module and a pin located on said support member and adapted to fit into said aperture to pivotally mount said guide assembly to the first subsystem module.

14. A printing machine according to claim 13, wherein said retaining member further comprises:

a slot located in the first subsystem module;

a second pin located on said support member and sized so as to be moveable in and along said slot so as to limit the movement of said guide assembly from the first position to the second position.

15. A self adjusting sheet baffle for connecting a plurality of subsystem modules in an electrophotographic printing machine, comprising:

a pair of elongated members located adjacent and substantially parallel to each other so as to form a sheet guide throat therebetween;

a support member connecting said parallel members at each end thereof to form a guide assembly;

retaining member, located on said support member to movably attach the support member to a first subsystem module, wherein the guide assembly is moveable from a first position which bridges a gap between the subsystem modules, to a second position which opens the gap, and wherein said guide assembly in moving from the second position to the first position is limited in movement by contacting a subsystem module preceding the first subsystem module.

* * * * *